US005361955A

United States Patent [19]

Gregory

[11] Patent Number: 5,361,955

[45] **Date of Patent: * Nov. 8, 1994**

[54] MODULAR BACKPACK

[75] Inventor: Wayne B. Gregory, Temecula, Calif.

[73] Assignee: Bianchi International, Temecula, Calif.

[ * ] Notice: The portion of the term of this patent subsequent to Jul. 20, 2010 has been disclaimed.

[21] Appl. No.: 994,208

[22] Filed: Dec. 21, 1992

[51] Int. Cl.[5] ..... A45F 3/04

[52] U.S. Cl. ..... 224/211; 224/213; 224/215; 224/907

[58] Field of Search ..... 224/211, 213, 215, 216, 224/262, 261, 907

[56] References Cited

U.S. PATENT DOCUMENTS

| | | | |
|---|---|---|---|
| 4,676,418 | 6/1987 | Lowe | 224/215 |
| 5,228,609 | 7/1993 | Gregory | 224/907 |

FOREIGN PATENT DOCUMENTS

| | | | |
|---|---|---|---|
| 2754061 | 6/1979 | Germany | 224/907 |
| 3829145 | 3/1990 | Germany | 224/213 |
| 9105493 | 5/1991 | WIPO | 224/215 |

OTHER PUBLICATIONS

Gregory Catalog–1991 p. 3 Published Dec. 1990.
Gregory Dealer Workbook 1991–92 pp. 21, 22, and 23.

*Primary Examiner*—Renee S. Luebke
*Attorney, Agent, or Firm*—Wagner & Middlebrook

[57] ABSTRACT

A modular backpack for carrying heavy loads over substantial periods of time includes a back panel with a polyfoam layer, a stretch fabric cover, and a fabric layer between the polyfoam layer and the back panel, all thermally molded to the back panel to define a number of smaller polyfoam pads, a carry bag attached to the back panel, a separate waist support having separate molded left and right waistband pads fastened thereto, a molded bun pad of multilayered polyfoam positioned between the waistband pads and stitched to the lower part of the back panel and to a bottom panel of the carry bag, leaving a space between itself and the back panel to insert and remove the waist support and waistband pads. A pair of generally triangular stress panels are stitched to the lower part of the back panel on each side so as to overlay the outside of the waistband pads and padded shoulder straps are attached to the stress panels and to the upper part of the back panel.

12 Claims, 4 Drawing Sheets

MODULAR BACKPACK

BACKGROUND OF THE INVENTION

This invention relates to backpacks and particularly to a backpack structure suitable for carrying maximum loads over extended time periods. Those who carry substantial loads over long periods soon become aware of discomfort from pressure points at any of a number of locations resulting from parts of the load becoming concentrated. Typical areas of such concentrated loads may be on the shoulders or hips. Or the back itself may become tired if too much of the load has been carried on the shoulders for too long, rather than on the hips. To deal with such problems, manufacturers of backpacks have provided padded shoulder straps, padded hip or waistbands, padded back panels, etc. Typically the back and waistband padded members have been formed in a single unit. It has been found that even with the padding, all areas of discomfort are not always dealt with adequately and that some pressure points are actually introduced by the pads themselves. Some padded members will tend to wrinkle and bunch up when carried as over one's shoulders or around one's waist resulting in creating uncomfortable pressure points. It has also been found that when the waistband members are combined with the back panels, there is frequently a lack of flexibility which results in the pack not fitting as well as would be desirable.

SUMMARY OF THE INVENTION

Applicant has found that by forming a number of padded areas of the backpack with polyfoam pads, some of which are spaced from each other, and with a cover of stretch synthetic fabric molded to the pads, many of the above problems are alleviated. The pads stay in place and do not bunch up and any wrinkling is eliminated because excess material is dealt with by means of the stretch fabric being molded into the spaces between the pads. In addition, by arranging the backpack as a group of modular units, flexibility in sizing is enhanced, providing a more precise fit to the wearer.

Older types of backpacks have used an aluminum frame to which are attached a carry bag and various shoulder straps, waist belts etc. Applicant's pack is primarily supported by means of an internal back panel of a thin but relatively stiff plastic material such as high density polyethylene to which is attached a plurality of elongated vertical pockets. In the pockets are placed stays of graphite fiber material which conform generally to the back contour of the wearer and which add some stiffness to the back panel. The principal carry bag is attached to one side of the back panel and also to a polyfoam pad structure attached to the side which is against the wearer's back. This pad structure has a cover of stretchable synthetic fabric such as nylon which is molded to the polyfoam pad structure and to the back panel. The pad structure is divided into a number of individual pad sections with creases between. The resulting structure will not wrinkle or bunch up because each pad section and the cover are secured in place by the molding process.

Below the back panel is a waist support member, not attached to the back panel, which extends across the wearer's back at the waist and hip level and which has two laterally extending arms. These arms support two separable waistband members each of which includes a backing part and a thin polyfoam layer to which is fastened a plurality of laterally spaced polyfoam pads. The pads are covered with a stretchable synthetic fabric and the assembly thermally molded together. The waistband members are subjected to substantial curvature in wrapping around a wearer's waist and the molded assembly retains all the pads and their cover in place without wrinkling or bunching up.

Between the waistband members and overlying the center part of the waist support member is a separate pad, called a bun pad, which is also a molded unit. This bun pad is formed by polyfoam layers of three different densities, one of which is open cell material, covered with a stretchable synthetic fabric and molded as described above. This pad is sewed at its top end to the back pad and at its lower end to the bottom panel of the carry bag.

Stitched to the carry bag and to opposite sides of the back panel near the lower end thereof are two generally triangular stress panels. These panels also overlay the waistband members on the outside. A buckle is fastened to each stress panel so that a stabilizing strap, discussed below, may be attached. A second strap and D-buckle (not shown) is fastened near the outboard end of each of stress members 30 and 32. Additional straps fastened to the waistband members 26 and 28 at a distance further outboard from the carry bag are fed through the D-buckle to enable the wearer to tighten the stress panels and waistband members around the wearer's waist.

A number of spaced slots are located near the top of the back panel which provide alternate positions for the attachment of shoulder straps. The shoulder straps, which have molded polyfoam pads with stretch fabric covers, include short pieces of webbing to which are attached some flat Figure-8 fasteners. These fasteners will pass through the slots and are then turned 90 degrees so that they will not readily pull through the slots again, thereby anchoring the tops of the shoulder pads. Also attached to the shoulder pads are load control panels which carry the tensile load of the shoulder straps and to which are attached the stabilizing straps. The stabilizing straps are attached at the top of the back panel and also to the stress panels described above and include slide buckles to enable the wearer to shift a part of the load between his or her shoulders and hips.

DESCRIPTION OF THE PREFERRED EMBODIMENT

Figure 1:
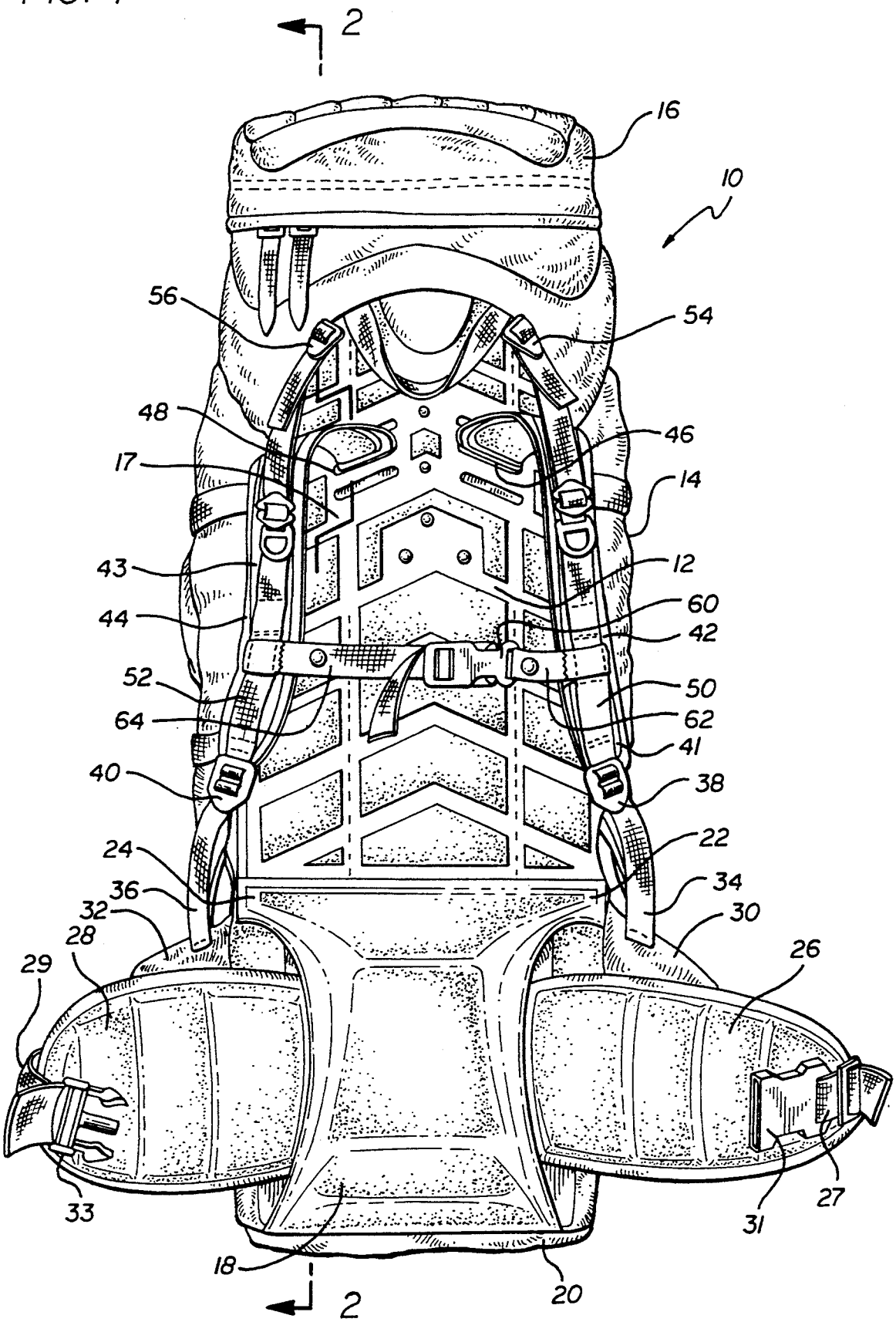
FIG. 1 is a front elevation of a backpack according to my invention.

Referring now to FIG. 1, a front view of a backpack according to my invention is shown at numeral 10 including a padded back panel 12 and a carry bag 14 fastened to the back panel 12. A top pocket 16 is fastened at the top end of back panel 12. The back panel includes a thin backing member of semi stiff plastic such as high density polyethylene overlaid with a polyfoam pad 17 having a fabric back and a cover of stretchable fabric; the cover, pad, fabric back, and backing members all being thermally molded together and with the polyfoam pad being compressed to form grooves separating a substantial number of relatively small individual pad sections which contact the back of the wearer. This prevents any wrinkling or bunching of the pads or its cover which could cause discomfort to the wearer.

A bun pad 18 is stitched at its upper end to the back panel 12 and at its lower end to a bottom panel 20 forming part of the carry bag 14. Except for short sections 22, 24 at the upper end, bun pad 18 is not stitched to the pack panel 12 at the sides, thereby leaving a passage for insertion of a waistband structure, of which two waistband pads 26 and 28 are shown in this drawing.

A pair of generally triangular stress panels 30 and 32 of heavy fabric are fastened to each side of the back panel 12. These stress panels overlay the waistband pads 26 and 28 on the outside and carry a pair of strap members 34,36 respectively which attach to slide buckles 38, 40. Also located to the outside of waistband pads 26 and 28 are web belt members 27 and 29 which pull the waistband pads around the wearer's waist and which are fastened together by means of quick release buckle members 31 and 33.

A pair of shoulder pad members 42 and 44 are fastened at their top end to back panel 12 by means of fasteners which are preferably in the form of flattened Figure-8 slides which slip through selected slots 46, 48 in the back panel 12 and which are then turned 90 degrees to latch behind the panel. Attached to the shoulder pad members 42, 44 by means of loop and hook fasteners are load control panels 41 and 43 to which are sewed stabilizing straps 50 and 52. These stabilizing straps carry buckles 38, 40 at their lower end to which strap members 34, 36 are attached. Attached to the upper end of back panel 12 are a pair of short straps carrying slide buckles 54, 56 to which stabilizing straps 50 and 52, respectively, are attached. By adjusting the length of stabilizing straps 50, 52 by means of the slide buckles 54, 56 and 38, 40 the wearer may shift the weight of the backpack and its load between his or her shoulders and hips.

To keep the shoulder pad members 42, 44 from spreading to the outside, a sternum strap is looped over the stabilizing straps 50 and 52 and fastened in the center by means of a quick release buckle 60. This strap preferably includes two separate web members 62, 64, one of which is somewhat elastic, to minimize any inhibition of breathing of the wearer.

Figures 2, 2A:
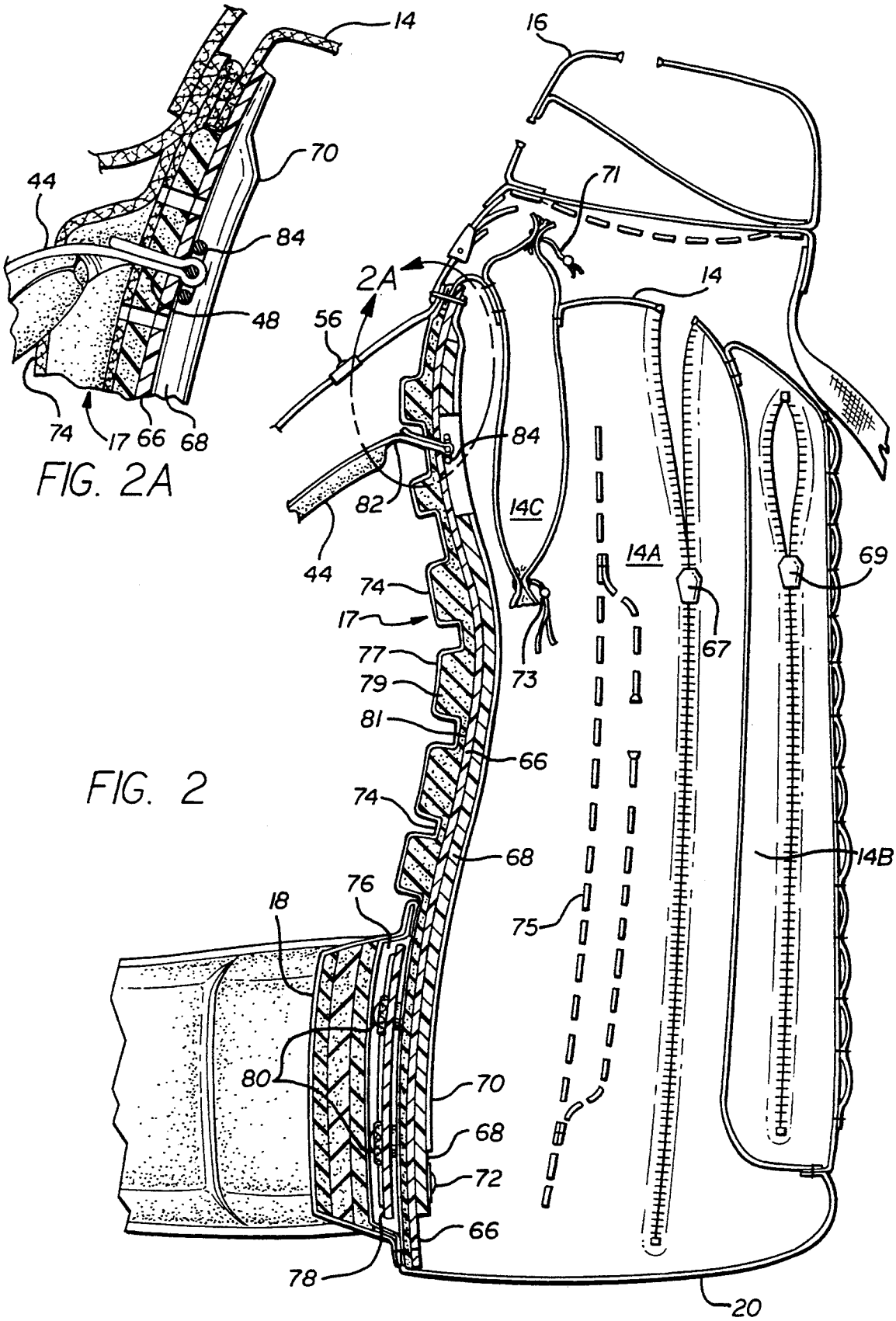
FIG. 2 is a sectional drawing taken along line 2—2 of FIG. 2.
FIG. 2A is an enlarged fragmentary part of FIG. 2, found within circle 2A.

FIG. 2 is a cross sectional view taken along line 2—2 of FIG. 1. The carry bag 14 is shown in the view attached to a backing member 66 which is of a thin semi-stiff plastic sheet material such as high density polyethylene. The carry bag 14 may take a number of forms. In this case it includes a main chamber 14A accessed by a slide fastener 67, a second chamber 14B accessed by a second slide fastener 69 and a smaller chamber 14C located near the top of carry bag 14 and secured by drawstrings 71 and 73. An internal mesh divider 75 may also be included.

One of two stays 68 of graphite fiber are secured to backing member 66; stay 68 being placed in a fabric sleeve 70 attached to backing member 66 and pinned to member 66 at its lower end by means of a rivet 72. On the opposite side of backing member 66 is the back pad 17 including an outside layer of stretch fabric 74, the polyfoam layer 79 and an inside fabric layer 81, all of which are thermally molded to the backing member 66.

The bun pad 18 and the lower panel 20 of the carry bag are both stitched to the lower edge of the molded assembly including the backing member 66, the polyfoam pad 17, and its stretchable fabric cover 74. This leaves a space or passage 76 between the lower part of polyfoam pad 17 and the inside surface of the bun pad 18. In this space is located a waist support member 78 which is of hard plastic material such as high density polyethylene but thin so that it will bend around a wearer's waist. Attached to waist support member 78 are snap fastener members 80 which mate with similar fasteners on waistband pads 26 and 28 to secure the waistband pads to the waist support member 78. Note that the waist support member is quite separate from the back panel 14, so the waistband pads 26 and 28 are free to move independently of the back panel. This is not true of some currently available designs in which the waistband pads are formed together with the back panel and pad. Also, the modular design makes it possible to easily replace the waistband pads without affecting the back panel and pads in any way.

FIG. 2A is a view on an enlarged scale of the portion of FIG. 2 shown within the area marked 2A. In this figure will be seen a part of the carry bag 14 to which is attached the molded assembly including the backing member 66, stay 68, fabric sleeve 70 and the polyfoam back pad 17 with its fabric cover 74. Shown also is the slot 48 through which is inserted one end of an extension of the shoulder pad 44 consisting of a short section of webbing strap material 82 which captures a flattened Figure-8 fastener 84. This fastener is slipped through the slot 48 and turned 90 degrees which causes it to latch behind the backing member 66.

Figure 3:
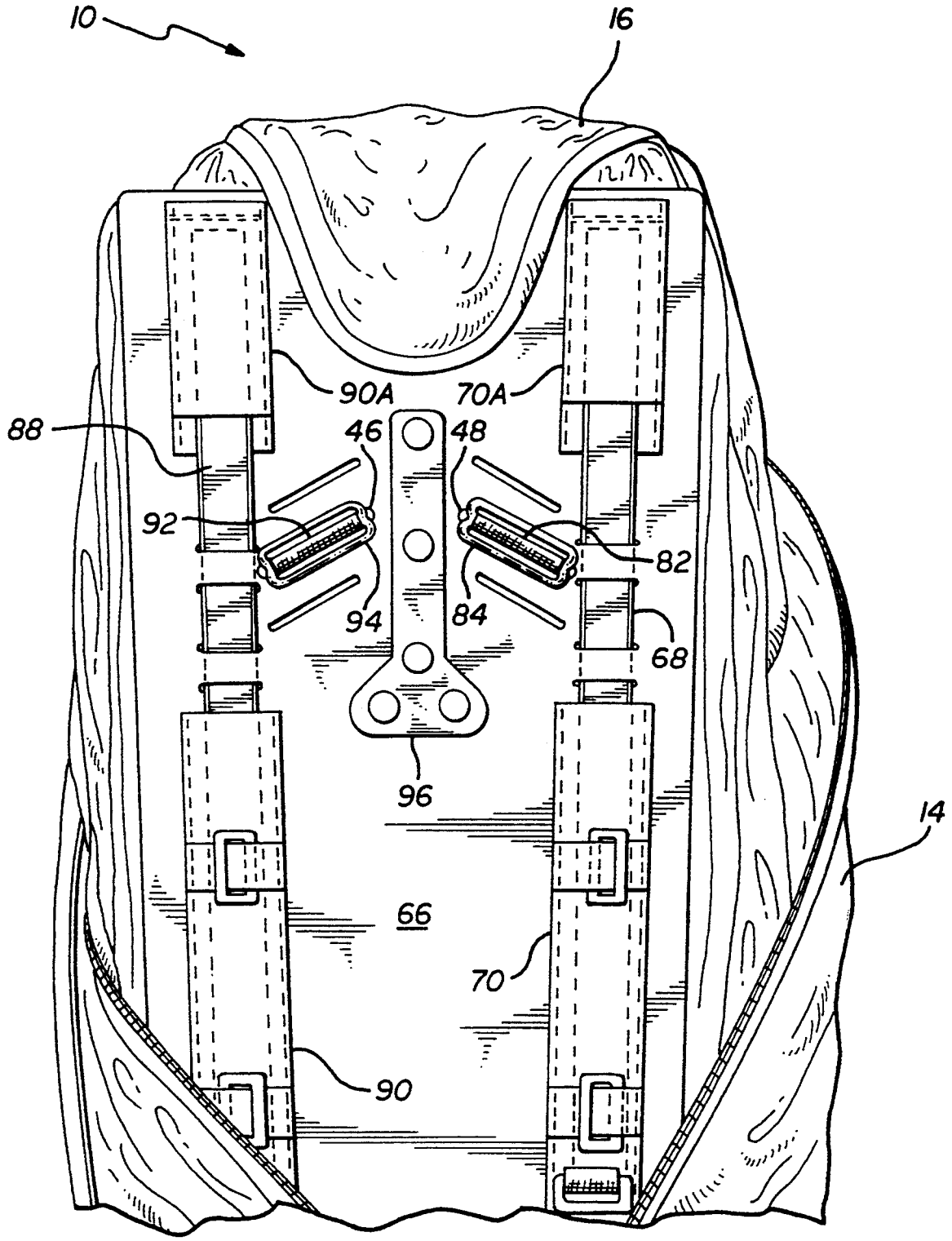
FIG. 3 is a fragmentary rear elevational view of the back panel of the backpack of FIGS. 1 and 2.

FIG. 3 is a fragmentary rear elevational view of the back panel of the backpack of FIGS. 1 and 2. In this view is seen the back of backing member 66 to which is attached the carry bag 14 and the top pocket 16. A pair of graphite fiber stays 68 and 88 are carried in fabric sleeves 70, 70A and 90, 90A. Also shown are the back sides of slots 46 and 48 and adjacent slots provided for adjustment of the shoulder pads 42 and 44. Attached to the upper ends of the shoulder pads 42 and 44 are web strap members 82 and 92 fastened around flattened Figure-8 fasteners 84 and 94, respectively, which are pushed through slots 46 and 48 and then turned 90 degrees to latch behind the back panel 66 which secures the top ends of the shoulder pad members 42, 44.

Because back panel 66 is of limited stiffness and because this stiffness is further reduced by the slots 46 and 48 and adjacent slots, a separate stiffener 96 of high density polypropylene which is somewhat more than twice the thickness of back panel 66 is riveted to back panel 66 between each set of slots as shown.

Figure 4:
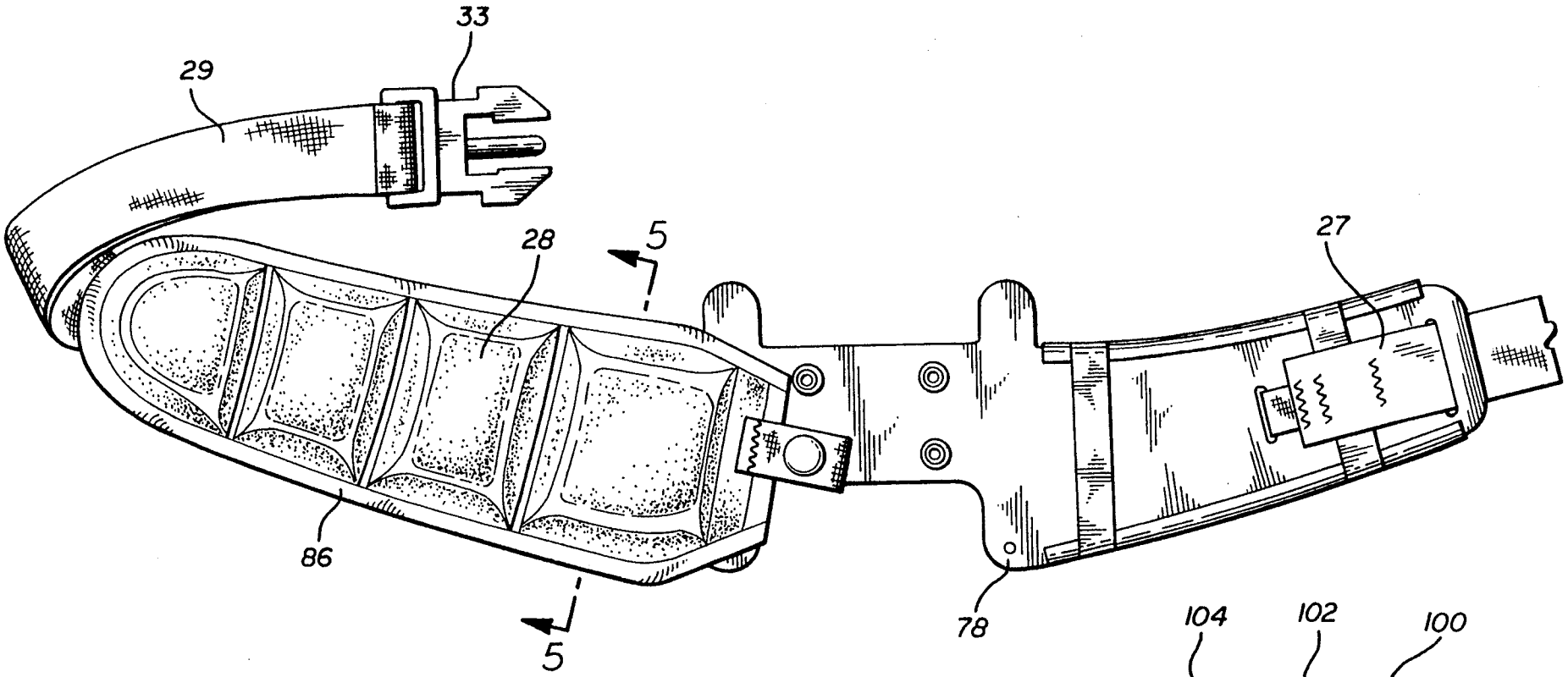
FIG. 4 is a plan view of a waistband member and pad forming part of the backpack of FIG. 1.

FIG. 4 is a plan view of the waist support member 78 removed from the back pack with one of the waistband pads 28 shown attached on its left arm. On the right arm is shown web belt member 27 attached through slots in the waist support member 78. The web belt member 29 is similarly attached to waist support member 78.

Figure 5:
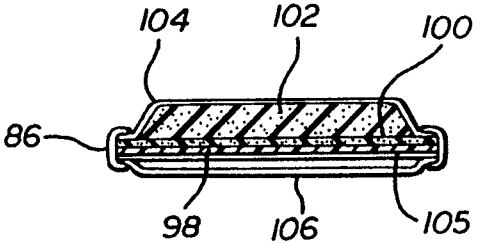
FIG. 5 is a sectional drawing taken along line 5—5 of FIG. 4.

As shown in FIG. 5, each of waistband pads 26 and 28 includes a backing 98 of stiff, but thin and somewhat bendable plastic sheet such as high density polyethylene, to which a thin polyfoam layer 100 and a plurality of polyfoam pads 102 are bonded and having a cover 104 of stretchable but durable fabric, with the cover, pads and backing thermally bonded together. The cover is bonded to the thin polyfoam layer 100 between the pads which secures the pads in position. At the back of each of waistband pads 26 and 28 is a fabric cover 105 and a wide strip 106 of a durable fabric which serves as a sleeve and which is slipped over an arm of the waist support member 78 to secure the waistband pads to the waist support member. A heavy binding 86, stitched around the periphery of the waistband pads 26 and 28 secures the edges of the pads and top and bottom edges of the sleeves.

While a single embodiment has been described herein, it is recognized that modifications will occur to those skilled in the art, and I do not desire to be limited other than by the scope of the following claims, including their equivalents.

I claim:

1. A backpack having a back panel, a carry bag attached to said back panel having a bottom panel, padded shoulder straps, padded waistband members, and fastening means for fastening said backpack around a wearer;

said back panel being of relatively stiff plastic material, a back pad member adjacent said back panel including poly foam cushion material and a stretch fabric cover, said back panel, polyfoam cushion material and cover being molded together;

a waist support member of relatively stiff plastic material unattached to said back panel including laterally extending arms, waistband members carried on the arms of said waist support member, said waistband members including spaced polyfoam pads and a fabric cover of stretchable fabric molded thereto, a back cover of heavy fabric stitched to said molded pads along its edge, a second layer of heavy fabric stitched over said first layer of heavy fabric and forming a sleeve therewith with each of said waistband members being attached to said arms by means of said sleeves, and a separate bun pad located between said waistband members stitched at its top to said back pad member and at its lower end to said bottom panel and formed of a plurality of layers of polyfoam of different densities and which has a cover of stretchable fabric molded to said polyfoam.

2. A backpack as claimed in claim 1 wherein said back pad is molded with said stretchable fabric cover to form a plurality of vertically and horizontally spaced polyfoam pads.

3. A backpack as claimed in claim 1 wherein stay members of graphite fiber material are attached to said back panel, and said back panel has fastened thereto a pair of elongated pockets and said stays are carried in said pockets.

4. A backpack comprising:

a) a back section having a panel of relatively stiff plastic material;

b) a carry bag attached to said panel having a bottom panel;

c) a pair of elongated stays fastened to said panel;

d) a back pad of polyfoam and a cover of stretchable fabric molded to said polyfoam pad and said panel to form a plurality of vertically and horizontally spaced polyfoam pads;

e) a waist support of relatively stiff plastic material having a center section and right and left extending arms;

f) a pair of waistband members, each including a backing member and a plurality of horizontally spaced polyfoam pads on said backing member and having a cover of stretchable fabric molded to said backing member and said polyfoam pads, a cover of strong fabric on the opposite side of said waistband member from said stretchable fabric, a second layer of strong fabric stitched over said cover of strong fabric to form a sleeve, with said waistband members being attached to said right and left extending arms by means of said sleeves;

web belt members attached to said waist support;

h) fastening members attached to said web belt members; and i) a separate bun pad of polyfoam material positioned between said waistband members, said bun pad being stitched at its lower end to said bottom panel and at its upper end to said back pad and open at the sides to permit removal of said waistband members.

5. A backpack as claimed in claim 4 wherein said bun pad is formed of a plurality of layers of polyfoam of different densities and has a cover of stretchable fabric molded to said polyfoam.

6. A backpack as claimed in claim 4 wherein said waistband members are fastened to said waist support member by means in addition to said sleeves.

7. A backpack as claimed in claim 4 wherein said waistband members are fastened to said waist support members by means of heavy snap fasteners.

8. A backpack as claimed in claim 4 wherein said back section includes a plurality of slots and said shoulder straps include fasteners for attachment to said back section by latching behind said slots.

9. A backpack as claimed in claim 4 wherein said stay members are of graphite fiber, said back panel has fastened thereto a pair of elongated pockets and said stays are carried in said pockets.

10. A backpack including a back section, a carry bag having a bottom panel attached to said back section, shoulder straps and fastening means for fastening the backpack around a wearer's waist;

said back section comprising:

a) a back panel of thin but relatively stiff plastic material, a pair of elongated pockets fastened to said back panel, a pair of stays in said pockets, a back pad of polyfoam and a cover of stretchable fabric molded to said polyfoam attached to said back panel;

b) a waist support of thin but relatively stiff plastic material having a center section and right and left extending arms;

c) a pair of waistband members each having a backing member, polyfoam pads attached to said backing member and a cover of stretchable fabric molded to said polyfoam pads and said backing member, a cover of strong fabric on the opposite side of said waistband member from said stretchable fabric, a second layer of strong fabric stitched over said cover of strong fabric to form a sleeve, with said waistband members being attached to said right and left extending arms by means of said sleeves;

d) said fastening means comprising web belt members attached to said waist support and quick release buckle members attached to said web belt members;

e) a separate bun pad of polyfoam material positioned between said waistband members, said bun pad being stitched at its lower end to said bottom panel and at its upper end to said back pad, said bun pad being formed of a plurality of layers of polyfoam of different densities and having a cover of stretchable fabric molded to said polyfoam.

11. A backpack as claimed in claim 10 wherein said back pad is molded with said stretchable fabric cover to form a plurality of vertically and horizontally spaced polyfoam pads.

12. A backpack as claimed in claim 10 wherein said waistband members each include a backing member and a plurality of horizontally spaced polyfoam pads on said backing member.

* * * * *